US008657579B2

(12) United States Patent
Reno

(10) Patent No.: US 8,657,579 B2
(45) Date of Patent: Feb. 25, 2014

(54) BLADE FOR USE WITH A ROTARY MACHINE AND METHOD OF ASSEMBLING SAME ROTARY MACHINE

(75) Inventor: Kyle William Reno, Greenville, SC (US)

(73) Assignee: General Electric Company, Schenectady, NY (US)

( * ) Notice: Subject to any disclaimer, the term of this patent is extended or adjusted under 35 U.S.C. 154(b) by 635 days.

(21) Appl. No.: 12/870,445

(22) Filed: Aug. 27, 2010

(65) Prior Publication Data

US 2012/0051921 A1 Mar. 1, 2012

(51) Int. Cl.
*F01D 5/30* (2006.01)

(52) U.S. Cl.
USPC ..... 416/193 A; 415/209.4; 415/210.1

(58) Field of Classification Search
USPC ..... 416/193 A, 189, 191, 215; 415/173.6, 415/208.1, 208.2, 209.1, 209.4, 210.1, 228, 415/139
See application file for complete search history.

(56) References Cited

U.S. PATENT DOCUMENTS

| | | | | |
|---|---|---|---|---|
| 6,290,459 | B1 * | 9/2001 | Correia | 415/139 |
| 6,558,121 | B2 * | 5/2003 | Zhu et al. | 416/193 A |
| 7,134,842 | B2 | 11/2006 | Tam et al. | |
| 7,249,928 | B2 * | 7/2007 | Klasing et al. | 415/115 |
| 7,261,518 | B2 | 8/2007 | Golinkin et al. | |
| 7,293,957 | B2 | 11/2007 | Ellis et al. | |
| 2007/0020102 | A1 | 1/2007 | Beeck et al. | |
| 2010/0040460 | A1 | 2/2010 | Spangler et al. | |
| 2010/0080708 | A1 | 4/2010 | Gupta et al. | |

* cited by examiner

*Primary Examiner* — Nathaniel Wiehe
*Assistant Examiner* — Justin Seabe
(74) *Attorney, Agent, or Firm* — Armstrong Teasdale LLP

(57) ABSTRACT

A method for assembling a rotary machine includes providing a rotor including a plurality of rotor wheels. The method also includes positioning the rotor such that at least a portion of a stationary portion of the rotary machine extends at least partially about the rotor. The method further includes providing a blade that includes a blade platform that is formed with a substantially double-C shape. The method also includes coupling the blade to the rotor.

20 Claims, 6 Drawing Sheets

BLADE FOR USE WITH A ROTARY MACHINE AND METHOD OF ASSEMBLING SAME ROTARY MACHINE

BACKGROUND OF THE INVENTION

The embodiments described herein relate generally to rotating machines and, more particularly, to methods and apparatus for assembling turbine engines.

At least some known turbine engines include a plurality of rotating turbine blades or buckets that channel high-temperature fluids, through gas turbine engines, or that channel steam through steam turbine engines. Known turbine buckets are typically coupled to a wheel portion of a rotor within the turbine engine and cooperate with the rotor to form a turbine section. Moreover, known turbine buckets are spaced circumferentially in a row extending about the rotor. Moreover, known turbine buckets are typically arranged in axially-spaced rows that are separated by a plurality of stationary nozzle segments that channel the fluid flowing through the engine towards each subsequent row of rotating buckets. Each row of segments, in conjunction with an associated row of turbine buckets, is usually referred to as a turbine stage and most known turbine engines include a plurality of turbine stages.

Moreover, at least some of the known gas turbine engines also include a plurality of rotating compressor blades that channel air through the gas turbine engine. Known rotating compressor blades are typically spaced circumferentially in axially spaced rows. Many known compressors also include a plurality of stationary nozzle segments, or stator vanes that channel air downstream towards the rotating compressor blades.

At least some known turbine buckets and/or known compressor blades each include an airfoil portion coupled to a platform portion. Platform portions of compressor blades and of turbine blades are generally circumferentially separated by a small tolerance. At least some known platforms are rectangular, and during operation, thermal expansion of the platforms reduces the small circumferential tolerances such that adjacent platforms may contact each other. Such contact forces are generally collinear, such that no net bending moment is induced to the turbine buckets and/or compressor blades, and such that a potential for overlapping or overhanging, that is, shingling of adjacent platforms is low. However, because some larger airfoils may not fit within a surface area defined by such platforms, a size of airfoils that may be used may be limited.

To accommodate larger airfoils at least some known platforms use non-rectangular geometries. However, contact of non-rectangular platforms such as trapezoidal shaped platforms induce nonlinear contact forces in the platforms, and/or induce torsional forces and/or bending moments into the turbine buckets and/or compressor blades. Over time, a likelihood or shingling of adjacent platforms is increased as compared to rectangular platforms. Such shingling may shorten a useful life of the associated turbine bucket and/or compressor blade.

BRIEF SUMMARY OF THE INVENTION

In one aspect, a method for assembling a rotary machine is provided. The method includes providing a rotor including a plurality of rotor wheels. The method also includes positioning the rotor such that at least a portion of a stationary portion of the rotary machine extends at least partially about the rotor. The method further includes providing a blade that includes a blade platform that is formed with a substantially double-C shape. The method also includes coupling the blade to the rotor.

In a further aspect, a blade for a rotary machine is provided. The rotary machine includes a rotor including at least one rotor wheel. The blade includes a dovetail portion configured to couple the blade to the at least one rotor wheel. The blade also includes a blade platform formed with a substantially double-C shape.

In another aspect, a turbine engine is provided. The engine includes a rotor comprising at least one rotor wheel. The engine also includes a stationary portion that extends at least partially about the rotor. The engine further includes at least one blade coupled to the at least one rotor wheel. The blade includes a blade platform formed with a substantially double-C shape.

BRIEF DESCRIPTION OF THE DRAWINGS

The embodiments described herein may be better understood by referring to the following description in conjunction with the accompanying drawings.

DETAILED DESCRIPTION OF THE INVENTION

Figure 1:
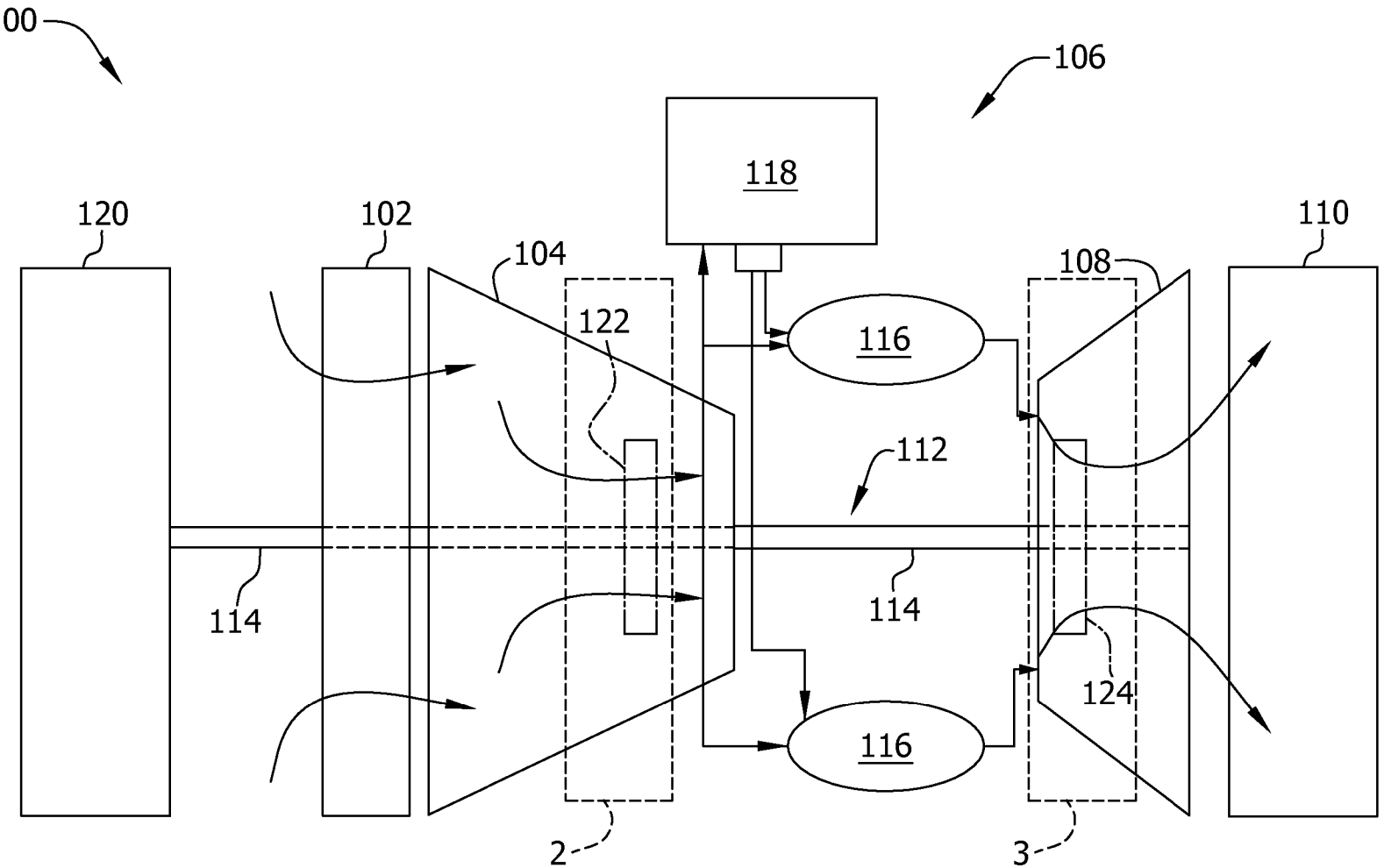
FIG. 1 is schematic diagram of an exemplary turbine engine.

FIG. 1 is a schematic view of a rotating machine 100, i.e., a turbine engine. In the exemplary embodiment, rotating machine 100 is a gas turbine engine. Alternatively, it should be noted that those skilled in the art will understand that other engines may be used. In the exemplary embodiment, turbine engine 100 includes an air intake section 102, and a compressor section 104 that is downstream from, and in flow communication with, intake section 102. A combustor section 106 is coupled downstream from, and in flow communication with, compressor section 104, and a turbine section 108 is coupled downstream from, and in flow communication with, combustor section 106. Turbine engine 100 includes an exhaust section 110 that is downstream from turbine section 108. Moreover, in the exemplary embodiment, turbine section 108 is coupled to compressor section 104 via a rotor assembly 112 that includes a drive shaft 114.

In the exemplary embodiment, combustor section 106 includes a plurality of combustors 116 that are each in flow communication with compressor section 104. Combustor section 106 also includes at least one fuel nozzle assembly 118. Each combustor 116 is in flow communication with at least one fuel nozzle assembly 118. Moreover, in the exemplary embodiment, turbine section 108 and compressor section 104 are rotatably coupled to a load 120 via drive shaft 114. For example, load 120 may include, but is not limited to only including, an electrical generator and/or a mechanical drive application, e.g., a pump. In the exemplary embodiment, compressor section 104 includes at least one compressor blade assembly 122. Also, in the exemplary embodiment, turbine section 108 includes at least one turbine blade or bucket mechanism 124. Each compressor blade assembly 122 and each turbine bucket mechanism 124 is coupled to rotor assembly 112.

In operation, air intake section 102 channels air towards compressor section 104. Compressor section 104 compresses inlet air via compressor blade mechanisms 122 to higher pressures and temperatures prior to discharging compressed air towards combustor section 106. Compressed air is mixed with fuel and ignited within section 106 to generate combustion gases that are channeled downstream towards turbine section 108. Specifically, at least a portion of compressed air is channeled to fuel nozzle assembly 118. Fuel is also channeled to fuel nozzle assembly 118, wherein the fuel is mixed with the air and ignited within combustors 116. Combustion gases generated within combustors 116 are channeled downstream towards turbine section 108. After impinging turbine bucket mechanisms 124, thermal energy in the combustion gases is converted to mechanical rotational energy that is used to drive rotor assembly 112. Turbine section 108 drives compressor section 104 and/or load 120 via drive shaft 114, and exhaust gases are discharged through exhaust section 110 to ambient atmosphere.

Figure 2:
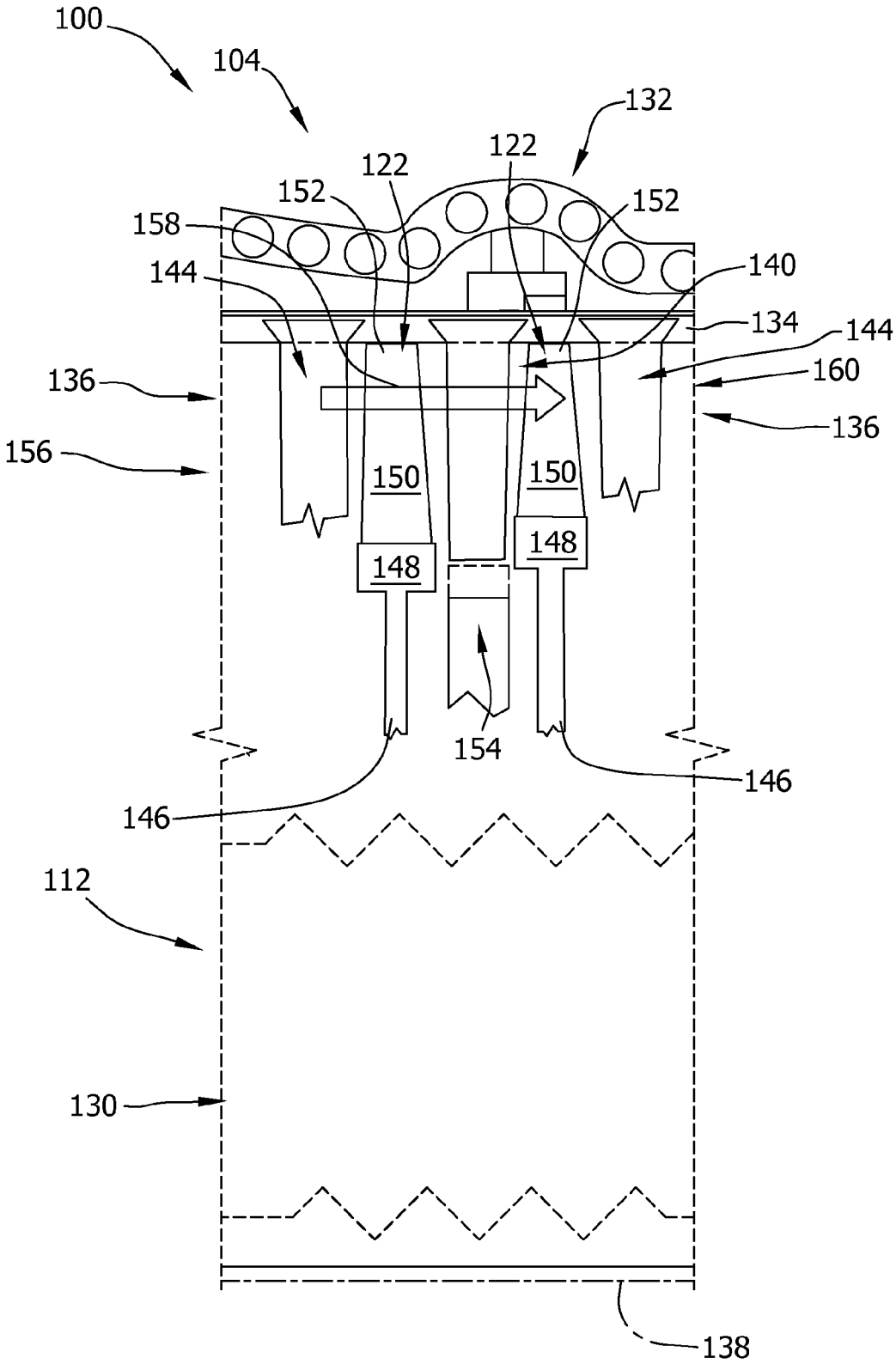
FIG. 2 is an enlarged cross-sectional view of a portion of a compressor that may be used with the turbine engine shown in FIG. 1 and taken along area 2.

FIG. 2 is an enlarged cross-sectional view of a portion of compressor section 104. In the exemplary embodiment compressor section 104 includes a compressor rotor assembly 130 and a stationary compressor stator assembly 132. Assemblies 130 and 132 are positioned within a compressor casing 134 that at least partially defines a flow path 136. In the exemplary embodiment, compressor rotor assembly 130 forms a portion of rotor assembly 112. More specifically, in the exemplary embodiment, compressor section 104 is oriented substantially symmetrically about a rotor axial centerline 138. Alternatively, compressor section 104 may be any rotating, bladed, multi-stage fluid transport apparatus that enables compressor section 104 to operate as described herein including, but not limited to, a stand-alone fluid compression unit or a fan.

Compressor section 104 includes a plurality of stages 140 (only one shown) that each include a row of circumferentially-spaced compressor blades 122 and a row of stator blades or stator vanes 144. In the exemplary embodiment, compressor blades 122 are coupled to a compressor rotor wheel 146 via an attachment mechanism 148 such that each blade 122 extends radially outwardly from rotor wheel 146. Also, in the exemplary embodiment, each blade 122 includes an airfoil portion 150 that extends radially outward from each blade attachment mechanism 148 to a rotor blade tip 152. Compressor stages 140 cooperate with a motive or working fluid such as, but not limited to, air. More specifically, the motive fluid is compressed in succeeding stages 140. An interstage seal mechanism 154 is coupled to each rotor wheel 146 and/or to each blade attachment mechanism 148.

In operation, compressor section 104 is rotated by turbine section 108 via rotor assembly 112. Fluid collected from a low pressure or compressor upstream region 156 via stages 140 is channeled by rotor blade airfoil portions 150 towards stator blade mechanisms 144. As the fluid is compressed, a pressure of the fluid is increased as the fluid is channeled through flow path 136 as indicated by a flow arrow 158. More specifically, the fluid flows through subsequent stages 140 and within flow path 136.

Compressed and pressurized fluid is subsequently channeled into a high pressure or compressor downstream region 160 for use within turbine engine 100.

Figure 3:
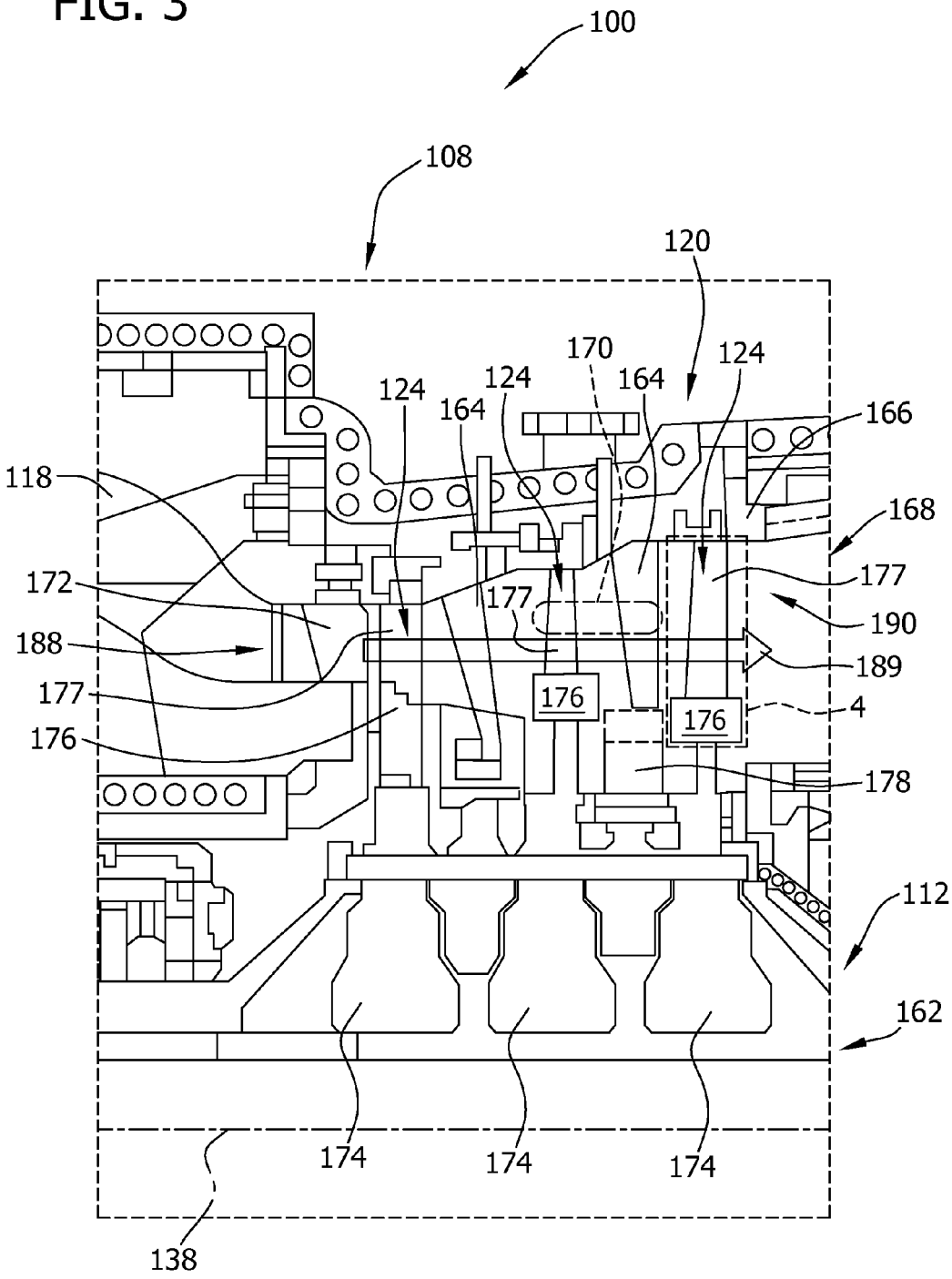
FIG. 3 is an enlarged cross-sectional view of a portion of a turbine that may be used with the turbine engine shown in FIG. 1 and taken along area 3.

FIG. 3 is an enlarged cross-sectional view of a portion of turbine section 108 that includes a turbine rotor assembly 162. Turbine section 108 also includes a plurality of stationary blades or turbine diaphragm assemblies 164 that are positioned within a turbine casing 166 that at least partially defines a flow path 168 therein. In the exemplary embodiment, turbine rotor assembly 162 forms a portion of rotor assembly 112. Moreover, in the exemplary embodiment, turbine section 108 is oriented substantially symmetrically about rotor axial centerline 138. Alternatively, turbine section 108 may be any rotating, bladed, multi-stage energy conversion apparatus that enables operation of turbine section 108 as described herein including, but not limited to, a steam turbine.

Turbine section 108 includes a plurality of stages 170 (only one shown) that each include a row of circumferentially-spaced rotor blades, or turbine bucket mechanisms, or turbine buckets 124 and a row of diaphragm assemblies 164, or a nozzle assembly 172. More specifically, in the exemplary embodiment, turbine section 108 includes three stages 170. Alternatively, turbine section 108 may include any number of stages 170 that enables turbine engine 100 to operate as described herein. In the exemplary embodiment, turbine buckets 124 are coupled to a turbine rotor wheel 174 via a bucket attachment mechanism 176. Also, in the exemplary embodiment, each turbine bucket 124 includes an airfoil portion 177 that extends radially outward from each bucket attachment mechanism 176. Turbine stages 170 cooperate with a motive or working fluid including, such as, combustion gases, steam, and/or compressed air. An interstage seal mechanism 178 is coupled to each rotor wheel 174 and/or bucket attachment mechanism 176.

In operation, turbine section 108 receives high pressure combustion gases generated by combustors 116 (shown in FIG. 1). Combustion gases collected from a high pressure region 188 via nozzle assembly 172 are channeled by turbine buckets 124 towards diaphragm assemblies 164. As the combustion gases are channeled through flow path 168, as indicated by an arrow 189, the combustion gases are at least partially decompressed. The combustion gases continue to flow through subsequent stages 170 prior to being discharged into a low pressure region 190 for further use within turbine engine 100 and/or exhausted from turbine engine 100.

Figure 4:
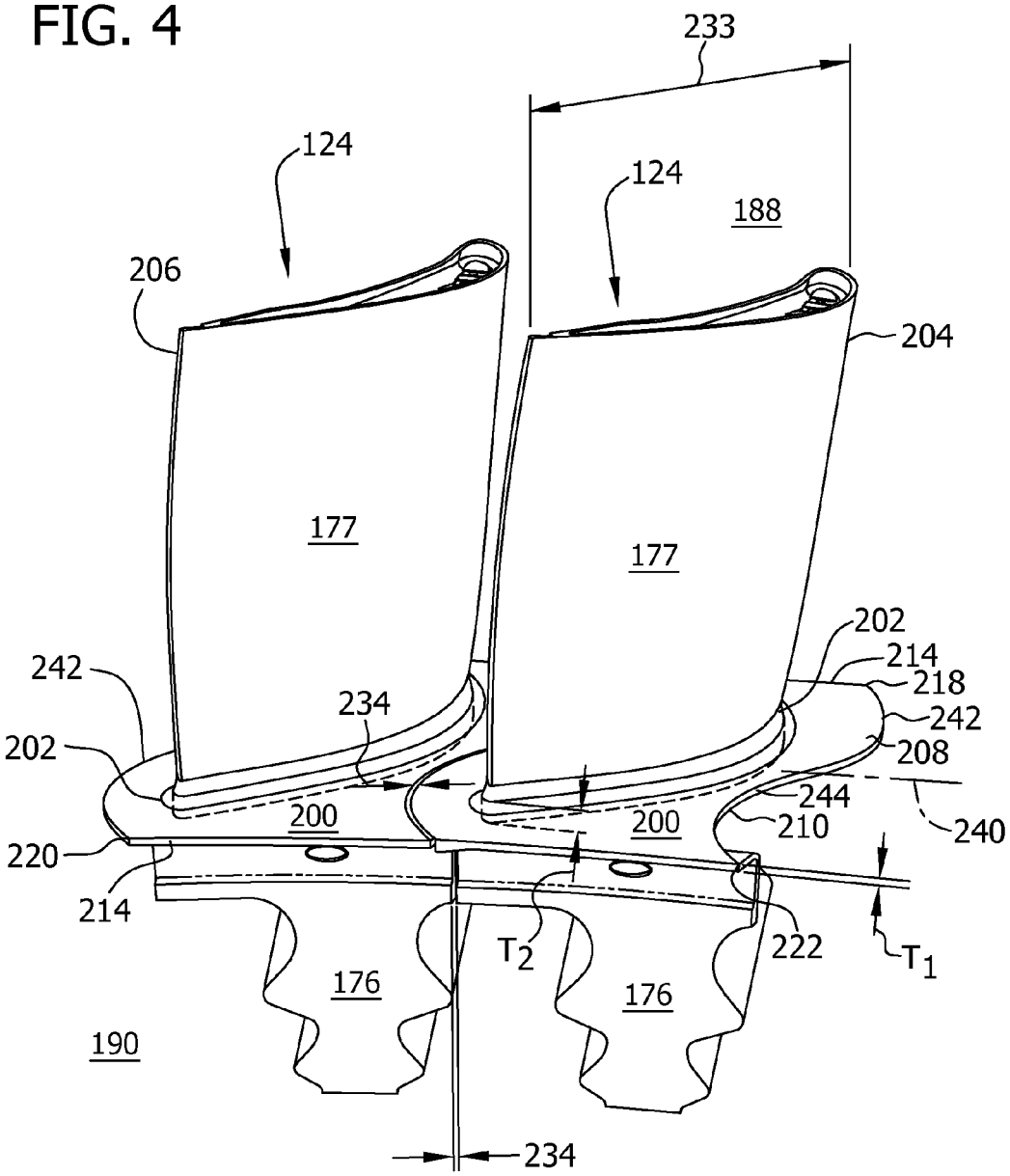
FIG. 4 is an axial schematic view of a plurality of exemplary bucket mechanisms that may be used with the turbine shown in FIG. 3 and taken along area 4.
Figure 5:
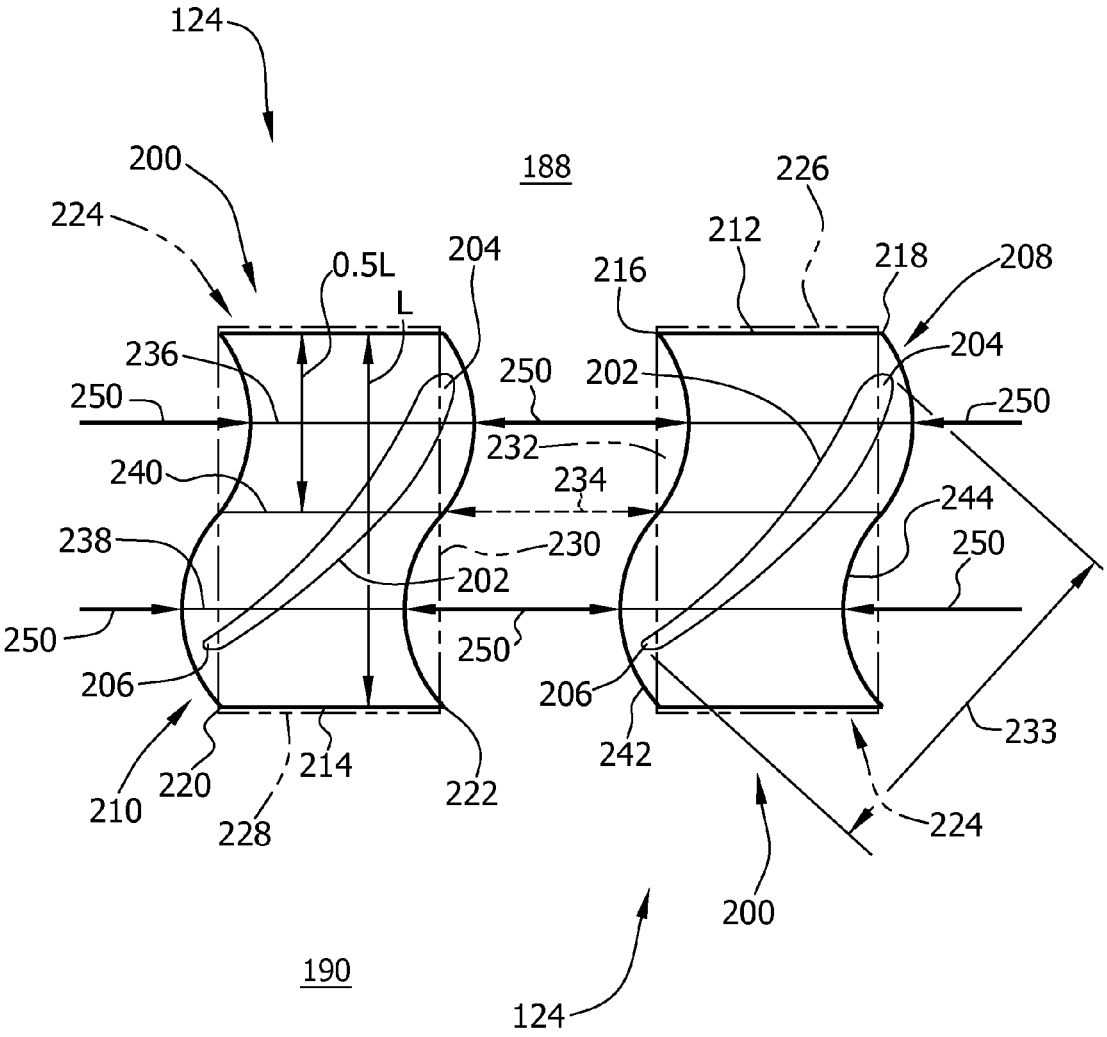
FIG. 5 is an overhead schematic view of a plurality of exemplary blade platforms that may be used with the bucket mechanisms shown in FIG. 4.

FIG. 4 is an axial schematic view of a plurality of exemplary blades, or buckets 124 that may be used with turbine section 108 and taken along area 4 (both shown in FIG. 3). FIG. 5 is an overhead schematic view of a plurality of exemplary blade, or bucket platforms 200 that may be used with buckets 124. Platforms 200 may also be used with compressor section 104 (shown in FIGS. 1 and 2), and more specifically, compressor blade 122 (shown in FIG. 2), wherein platforms 200 are thereby referred to as blade platforms. Hereon, the terms "blade platform" and "bucket platform", including pluralities thereof, are used interchangeably. Each bucket 124 includes an attachment mechanism 176 and a bucket airfoil portion 177. In the exemplary embodiment attachment mechanism 176 is a dovetail-type device. Moreover, in the exemplary embodiment, each bucket 124 also includes a bucket platform 200, each bucket platform 200 and airfoil portion 177 define an airfoil root portion 202. Also, in the exemplary embodiment, bucket attachment mechanism 176, bucket airfoil portion 177, and bucket platform 200 are unitarily formed together. Moreover, in the exemplary embodiment, each airfoil portion 177 includes a leading edge 204 and a trailing edge 206.

In the exemplary embodiment, each bucket platform 200 has a double-C shape or profile, i.e., each bucket platform 200 has a forward C-cut portion 208 and an aft C-cut portion 210 that form bucket platform 200. Specifically, forward C-cut portion 208 defines a forwardmost platform edge 212 and aft C-cut portion 210 defines an aftmost platform edge 214 of bucket platform 200. Forwardmost platform edge 212 includes a plurality of corners 216 and 218. More specifically, edge 212 includes a first forward coincident corner 216 and a second forward coincident corner 218. In addition, aftmost platform edge 214 includes a plurality of corners 220 and 222. More specifically, edge 214 includes a first aft coincident corner 220 and a second aft coincident corner 222. For purposes of illustration, corners 216, 218, 220, and 222 define a rectangular platform outline 224 that includes a forwardmost side 226, an aftmost side 228, a leading edge side 230, and a trailing edge side 232.

Rectangular platform outline 224 illustrates that exemplary bucket platform 200 receives a larger airfoil root portion 202 to be coupled thereto than possible using a rectangular platform as shown in outline 224. Such larger airfoil root portion 202 facilitates a larger airfoil 177, wherein airfoil 177 and root portion 202 define a bucket chord 233 that is further defined between leading edge 204 and trailing edge 206.

As such, use of larger airfoils 177 in turbine section 108 facilitates increased combustion gas flow 189 (shown in FIG. 3) through turbine section 108 as compared to the smaller rectangular platforms and associated smaller buckets, such increased gas flow 189 facilitates an increased power generation rating of turbine engine 100 (shown in FIG. 1) without increasing a footprint of engine 100. Similarly, use of larger airfoils 150 in compressor section 104 facilitates increased air flow 158 (shown in FIG. 2) through compressor section 104 as compared to the smaller rectangular platforms and associated smaller blades, such increased air flow 158 facilitates an increased power generation rating of turbine engine 100 without increasing a footprint of engine 100. Moreover, such larger airfoils 177 and 150 have a larger chord 233 than their smaller counterparts, such larger chord 233 facilitating a reduction in flow separation from airfoils 177 and 150, thereby facilitating an improvement in performance of turbine engine 100. Furthermore, larger airfoil root portion 202 as compared to a smaller counterpart facilitates a reduction in bending moments that may be otherwise induced in portions of airfoil portion 177 adjacent to root portion 202.

In the exemplary embodiment, a gap 234 is defined between circumferentially adjacent platforms 200. Also, in the exemplary embodiment, forward C-cut portion 208 defines a forward axis of symmetry 236 of bucket platform 200 and aft C-cut portion 210 defines an aft axis of symmetry 238 of bucket platform 200. Moreover, in the exemplary embodiment, forward C-cut portion 208 and aft C-cut portion 210 intersect to define a blade platform bifurcating axis 240. That is, in the exemplary embodiment, for a given axial platform length L, forward C-cut portion 208 and aft C-cut portion 210 each have an axial half-length of 0.5 L. As such, a symmetrical relationship of forward C-cut portion 208 and aft C-cut portion 210 across bifurcating axis 240 is defined. Alternatively, forward C-cut portion 208 and aft C-cut portion 210 do not have similar lengths of 0.5 L and have any incongruent lengths that enable operation of platform 200 as described herein, for example, without limitation, forward C-cut portion 208 has a length of 0.33 L and aft C-cut portion 210 has a length of 0.67 L. In such an example, bifurcating axis 240 is shifted towards forwardmost platform edge 212 and away from aftmost platform edge 214. Therefore, alternatively, bifurcating axis 240 is defined at any point along length L that enables operation of platform 200 as described herein.

Moreover, in the exemplary embodiment, both forward C-cut portion 208 and aft C-cut portion 210 define an outwardly extending portion edge 242 and a scalloped portion edge 244. Portion edges 242 and 244 are shaped to be complimentary to each other, that is, during installation of bucket attachment mechanism 176 into turbine rotor wheel 174, a portion edge 242 of a first platform 200 and a portion edge 244 of an adjacent platform 200 may be positioned such that gap 234 is substantially uniform therebetween and along length L. Further, in the exemplary embodiment, a first thickness $T_1$ of platform 200 at edges 212, 214, 242, and 244 is less than a second thickness $T_2$ of platform 200 at airfoil root portion 202, thereby defining a tapered thickness thereof.

In operation, especially during startup operations of turbine engine 100, blade platforms 200 heat up and expand circumferentially, thereby decreasing a distance of gap 234 defined between adjacent platforms 200 until circumferentially adjacent platforms 200 contact. In the exemplary embodiment, as adjacent platforms 200 contact, forces are induced on platforms 200 in a direction normal to portions of scalloped portion edge 244 and outwardly extending portion edge 242 of an adjacent platform 200. Also, in the exemplary embodiment, frictional forces are induced at an interface (not shown) defined between compressor rotor wheel 146 (shown in FIG. 2) and blade attachment mechanism 148. Such frictional forces create resistance to and oppose the forces that circumferentially adjacent platforms 200 exert on each other as they thermally expand. Further, in the exemplary embodiment, as forces are induced to platform 200, resultant forces 250 are induced in a substantially collinear direction to forward axis of symmetry 236 and to aft axis of symmetry 238. That is, forces 250 are symmetrical about forward axis of symmetry 236 and about aft axis of symmetry 238. Therefore, net moments induced on adjacent platforms 200 are facilitated to be reduced. Moreover, in the exemplary embodiment, because forces 250 are substantially symmetrical about bifurcating axis 240, net moments induced on adjacent platforms 200, are further facilitated to be reduced. As such a likelihood of shingling of edges 242 and 244 is also facilitated to be reduced. Alternatively, in those embodiments that include forward C-cut portion 208 and aft C-cut portion 210 with incongruent lengths, and bifurcating axis 240 shifted to a non-symmetrical position along length L accordingly, net moments induced on adjacent platforms 200 are also facilitated to be reduced due to forces 250 symmetrical about forward axis of symmetry 236 and about aft axis of symmetry 238.

Figure 6:
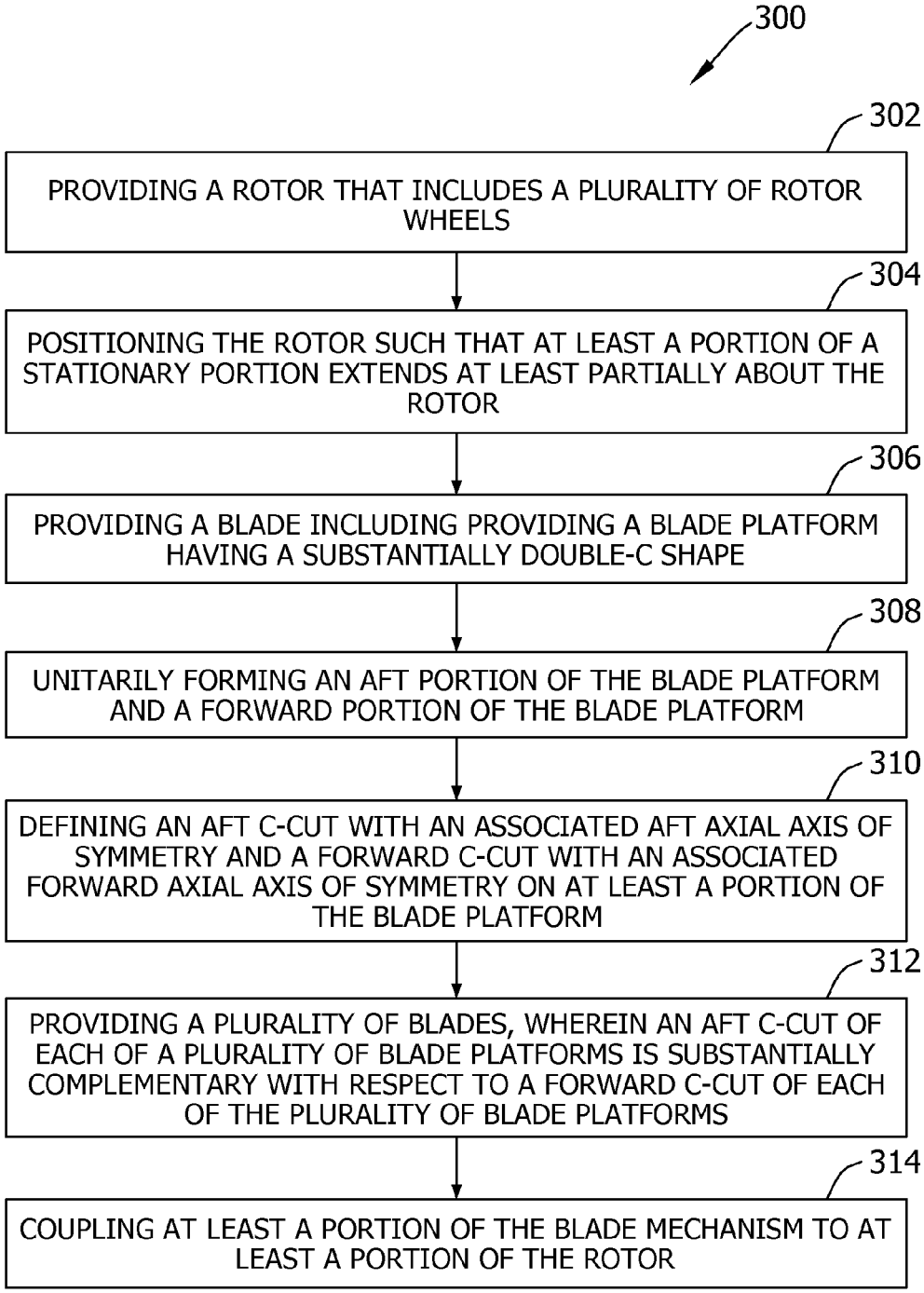
FIG. 6 is a flow chart illustrating an exemplary method of assembling a portion of the turbine engine shown in FIG. 1.

FIG. 6 is a flow chart illustrating an exemplary method 300 of assembling a portion of turbine engine 100 (shown in FIGS. 1, 2, and 3). In the exemplary embodiment, a rotor 112 is provided 302 that includes a plurality of rotor wheels 146/174 (shown in FIGS. 2 and 3, respectively). A compressor rotor assembly 130/turbine rotor assembly 162 (shown in FIGS. 2 and 3, respectively) is positioned 304 such that at least a portion of compressor stator assembly 132/turbine diaphragm assembly 164 (shown in FIGS. 2 and 3, respectively) extends at least partially about compressor rotor assembly 130/turbine rotor assembly 162. Compressor blades 122/turbine buckets 124 (shown in FIGS. 2 and 3, respectively) that include blade platforms 200 (shown in FIGS. 4 and 5) having a substantially double-C shape are provided 306. Specifically, aft portion 210 and forward portion 208 (both shown in FIGS. 4 and 5) are formed 308 such that they unitarily form bucket platform 200. More specifically, an aft C-cut with associated aft axial axis of symmetry 238 (shown in FIG. 5) and a forward C-cut with associated forward axial axis of symmetry 236 (shown in FIG. 5) are defined 310 on at least a portion of bucket platform 200. Also, in the exemplary embodiment, a plurality of blades 124 are provided 312, wherein an aft C-cut and a forward C-cut is formed within at least a portion of each of blade platforms 200, wherein each of the forward C-cuts is substantially complementary with respect to each of the aft C-cuts. Further, in the exemplary embodiment, at least a portion of blade mechanism 124 is coupled 314 to compressor rotor wheel 146/turbine rotor wheel 174.

Embodiments provided herein facilitate the assembly and operation, of turbine engines using larger compressor and turbine airfoils. Such larger airfoils facilitates increased power output ratings for a given engine footprint without increasing fabrication and assembly costs. Also, such operation of turbine engines is facilitated by reducing a potential for compressor and turbine blade platforms to overlap, or shingle, each other, thereby increasing a useful life of compressor blades and turbine buckets. Increasing useful lives of compressor blades and turbine buckets reduces turbine engine outage periods and maintenance costs.

Described herein are exemplary embodiments of methods and apparatus that facilitate assembly and operation of gas turbine engines. Specifically, forming platforms with a double-C profile, or shape facilitates use of larger airfoils and extends a useful life of turbine engine components. More specifically, the double-C profile of the compressor blade and turbine bucket platforms as described herein facilitates positioning larger airfoils on the associated platforms. Also, more specifically, the double-C profile as described herein uses complimentary adjacent platforms, that may expand and contact each other, to facilitate a reduction of additional induced unsymmetrical forces on any portions of the blade/bucket platforms. Therefore, a potential for platform overlapping, or shingling, is reduced, thereby facilitating an increase in a useful life of the platforms and associated turbine buckets and compressor blades. Moreover, a frequency and a duration of maintenance shutdowns may be reduced, and associated operational repair and replacement costs may be reduced.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assembly packages and methods.

While the invention has been described in terms of various specific embodiments, those skilled in the art will recognize that the invention can be practiced with modification within the spirit and scope of the claims.

What is claimed is:

1. A method for assembling a rotary machine, said method comprising:

providing a rotor including a plurality of rotor wheels;

positioning the rotor such that at least a portion of a stationary portion of the rotary machine extends at least partially about the rotor;

providing a blade that includes a blade platform having a leading edge that includes an aft C-cut and a forward C-cut that is substantially axially symmetrical with the aft C-cut; and coupling the blade to the rotor.

2. A method in accordance with claim 1, wherein providing a blade comprises providing a blade platform including an aft portion and a forward portion, wherein the blade platform is formed unitarily with the aft and forward portions, wherein the leading edge spans across the aft and forward portions.

3. A method in accordance with claim 2, wherein providing a blade further comprises:

providing a blade wherein the forward C-cut is formed within the forward portion of the blade platform; and providing a blade including a second forward C-cut formed along a trailing edge of the blade platform.

4. A method in accordance with claim 1, wherein providing a blade comprises providing a blade wherein the aft C-cut is inverted about an axis of symmetry in relation to the forward C-cut.

5. A method in accordance with claim 1, wherein providing a blade comprises providing a blade that includes a blade platform having a trailing edge that includes a trailing aft C-cut and a trailing forward C-cut that is substantially axially symmetrical with the trailing aft C-cut.

6. A method in accordance with claim 1, wherein providing a blade comprises providing a blade platform oriented such that the leading edge extends between a forward corner of the blade platform and an aft corner of the blade platform, wherein the forward corner and the aft corner define a leading edge axis that is substantially parallel to an axis of rotation of the rotor.

7. A method in accordance with claim 1, wherein providing a blade comprises providing a blade platform oriented such that one of the first C-cut and the second C-cut defines a convex portion of the leading edge and the other of the first C-cut and the second C-cut defines a concave portion of the leading edge.

8. A blade for a rotary machine that includes a rotor including at least one rotor wheel, said blade comprising:

a dovetail portion configured to couple said blade to the at least one rotor wheel, and a blade platform comprising a leading edge comprising an aft C-cut and a forward C-cut that is substantially axially symmetrical with the aft C-cut.

9. A blade in accordance with claim 8, wherein said blade platform further comprises:

an aft portion; and a forward portion formed unitarily with said aft portion of said blade platform, wherein said leading edge spans across said aft and forward portions.

10. A blade in accordance with claim 8, wherein said aft C-cut is inverted about an axis of symmetry in relation to said forward C-cut.

11. A blade in accordance with claim 8, wherein said blade platform further comprises a trailing edge comprising a trailing aft C-cut and a trailing forward C-cut that is substantially axially symmetrical with said trailing aft C-cut.

12. A blade in accordance with claim 8, wherein said leading edge extends between a forward corner of said blade platform and an aft corner of said blade platform, wherein said forward corner and said aft corner define a leading edge axis that is substantially parallel to an axis of rotation of the at least one rotor wheel.

13. A blade in accordance with claim 8, wherein one of said first C-cut and said second C-cut defines a convex portion of said leading edge and the other of said first C-cut and said second C-cut defines a concave portion of the leading edge.

14. A turbine engine comprising:

a rotor comprising at least one rotor wheel;

a stationary portion that extends at least partially about said rotor; and at least one blade comprising a dovetail portion configured to couple said blade to said at least one rotor wheel, and a blade platform comprising a leading edge comprising an aft C-cut and a forward C-cut that is substantially axially symmetrical with the aft C-cut.

15. A turbine engine in accordance with claim 14, wherein said blade platform further comprises:

an aft portion; and a forward portion formed unitarily with said aft portion of said blade platform, wherein said leading edge spans across said aft and forward portions.

16. A turbine engine in accordance with claim 15, wherein said aft portion of a first of said at least one blade and said forward portion of a second of said at least one blade are substantially complementary.

17. A turbine engine in accordance with claim 14, wherein said aft C-cut is inverted about an axis of symmetry in relation to said forward C-cut.

18. A turbine engine in accordance with claim 14, wherein said blade platform further comprises a trailing edge comprising a trailing aft C-cut and a trailing forward C-cut that is substantially axially symmetrical with said trailing aft C-cut.

19. A turbine engine in accordance with claim 14, wherein said leading edge extends between a forward corner of said blade platform and an aft corner of said blade platform, wherein said forward corner and said aft corner define a leading edge axis that is parallel to an axis of rotation of the at least one rotor wheel.

20. A turbine engine in accordance with claim 14, wherein one of mid first C-cut and said second C-cut defines a convex portion of said leading edge and the other of said first C-cut and said second C-cut defines a concave portion of the leading edge.

* * * * *

UNITED STATES PATENT AND TRADEMARK OFFICE

CERTIFICATE OF CORRECTION

PATENT NO. : 8,657,579 B2
APPLICATION NO. : 12/870445
DATED : February 25, 2014
INVENTOR(S) : Reno It is certified that error appears in the above-identified patent and that said Letters Patent is hereby corrected as shown below:

Claims

In Claim 20, column 9, line 28, delete "mid" and insert therefore -- said --.

Signed and Sealed this
Sixteenth Day of August, 2016

Michelle K. Lee

Michelle K. Lee
*Director of the United States Patent and Trademark Office*